United States Patent [19]

Pollich

[11] Patent Number: 5,076,165

[45] Date of Patent: Dec. 31, 1991

[54] SWINGING GRIPPER ARRANGEMENT FOR SHEET-PROCESSING MACHINES, IN PARTICULAR, SHEET-FED OFFSET PRINTING PRESSES

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 466,049

[22] Filed: Jan. 17, 1990

[30] Foreign Application Priority Data

Jan. 20, 1989 [DE] Fed. Rep. of Germany ..... 3901599

[51] Int. Cl.[5] ..... B41F 1/30

[52] U.S. Cl. ..... 101/409; 101/408

[58] Field of Search ..... 101/232, 407.1, 408, 101/409, 410, 411; 271/82, 277

[56] References Cited

U.S. PATENT DOCUMENTS

| | | | |
|---|---|---|---|
| 4,014,261 | 3/1977 | Becker | 101/410 |
| 4,026,209 | 5/1977 | Wirz et al. | 101/231 |
| 4,098,187 | 7/1978 | Wirz | 101/410 |
| 4,120,244 | 10/1978 | Wirz | 101/230 |
| 4,120,263 | 10/1978 | Boschet | 271/277 |
| 4,164,279 | 8/1979 | Dubult | 198/492 |
| 4,290,595 | 9/1981 | Thunker | 271/82 |
| 4,311,093 | 1/1982 | Aboudroth et al. | 101/232 |
| 4,357,870 | 11/1982 | Rudolph et al. | 271/82 |
| 4,362,105 | 12/1982 | Iwamoto | 101/411 |
| 4,475,459 | 10/1984 | Wanke et al. | 101/410 |
| 4,583,728 | 4/1986 | Mathes | 271/277 |
| 4,699,368 | 10/1987 | Hiraoka | 271/82 |
| 4,846,064 | 7/1989 | Hoshi | 101/419 |
| 4,854,236 | 8/1989 | Thunker et al. | 101/411 |
| 4,869,169 | 9/1989 | Rebel et al. | 101/408 |

FOREIGN PATENT DOCUMENTS

| | | | |
|---|---|---|---|
| 197803 | 3/1978 | Canada | 271/277 |
| 325720 | 9/1920 | Fed. Rep. of Germany | 101/409 |
| 3736808 | 9/1988 | Fed. Rep. of Germany | 101/409 |
| 259597 | 2/1927 | United Kingdom | 101/409 |

*Primary Examiner*—Edgar S. Burr
*Assistant Examiner*—Joseph R. Keating
*Attorney, Agent, or Firm*—Nils H. Ljungman & Associates

[57] ABSTRACT

A swinging gripper apparatus for use in a sheet-processing machine, which includes a rocker arm member having a pivotally mounted first end and a second end which is selectively positionable adjacent the cylinder or adjacent the feed table, a cam segment member having two opposing arcuate camming surfaces provided thereon, apparatus for moving the cam segment member closer to or further away from the pivotally mounted first end of the rocker arm member, at least one gripper member pivotally mounted on the second end of the rocker arm member for pivotal movement with respect thereto, a lever arm extending from the at least one gripper member, and a cam follower member mounted on the lever arm, the cam follower member being positioned between the two opposing arcuate surfaces provided on the cam segment member.

22 Claims, 5 Drawing Sheets

SWINGING GRIPPER ARRANGEMENT FOR SHEET-PROCESSING MACHINES, IN PARTICULAR, SHEET-FED OFFSET PRINTING PRESSES

BACKGROUND OF THE INVENTION

1. Field of the Invention

The present invention relates to a swinging gripper arrangement for sheet-processing machines, in particular, sheet-fed offset printing presses.

2. Description of the Prior Art

In known swinging grippers, for example in German Offenlegungsschrift 37 36 808, the grippers are fixed on a gripper shaft, the gripper shaft bearing a roller lever, the end-positioned roller of which is in contact with the outer edge of a cam segment. The gripper spring pulls the roller into a contact with the cam segment and is fixed at its other end on a roller lying opposite, the opposite lying roller being in contact with an equidistant inner cam of the cam segment and being seated on a roller arm which extends rigidly from the gripper rocker. The cam segment itself is swivelable about a pivot point against spring loading, the swivel motion being controlled by a feeler roller which rolls on a cam disc that is mounted coaxially with respect to the appropriate drum of the sheet-processing machine.

Such known devices may, in fact, reduce the vibrations occurring in the gripper system and thus diminish the occurrence of associated register errors. They are, however, not particularly well suited to optimally fulfilling all of the essential requirements of high-speed, high-performance printing presses. This has particularly been found to be the case in that the gripper spring itself must also be moved in line with the high-speed rhythm of such machines, with a significant role being played, not only by its mass, but also by the movement in space that occurs transversely with respect to the tensile force of the spring

OBJECT OF THE INVENTION

One object of the present invention is the provision of a swinging gripper arrangement having a simplified mode of construction which is suited for use on such high-performance machines.

SUMMARY OF THE INVENTION

A gripper arrangement is described herein for sheet-processing machines, in particular, sheet-fed offset printing presses, in which the springs and spring rods which act on the grippers, together with their means of attachment, need not be moved as a mass together with the gripper rocker. Thus, the grippers may not receive their spring loading from springs disposed directly at the gripper rocker, but from the spring loading of a cam segment.

Accordingly, in a most favorable adaptation of the desired characteristics, even bulky springs may be accommodated without increasing the weight of the gripper rocker. Moreover, the swinging gripper mechanism described herein may be readily operated at a rhythm suitable for the highest press speeds. There is, in addition a considerable reduction in any inherent vibrations occurring in the system composed of the grippers and their support.

A favorable design for the positive non-slip spring-loading control of the grippers results from the rocker-cam control according to the invention. A kinematically and spatially favorable lay-out of the entire arrangement is produced, firstly, by the provision of three arms for the cam segment, the arms extending from a central shaft and, secondly, by the application of force from the loading springs, controlled by a feeler roller.

One aspect of the invention resides broadly in a swinging gripper apparatus for use in a sheet-processing machine, such as a printing press, the sheet-processing machine having a cylinder for receiving, on the periphery thereof, sheets to be printed and a feed table for supplying the sheets to be printed, said swinging gripper apparatus comprising: a swinging means, said swinging means comprising: a rocker arm member, said rocker arm member having a pivotally mounted first end and a second end which is selectably positionable between a first position substantially adjacent the cylinder and a second position substantially adjacent the feed table; a cam segment member, said cam segment having at least one arcuate camming surface provided thereon; said cam segment member being pivotally mounted about a pivot point and being pivotal about said pivot point between a first orientation and a second orientation, said cam segment member being closer to said pivotally mounted first end of said rocker arm member in said first orientation than in said second orientation; at least one gripper member pivotally mounted on said second end of said rocker arm member for pivotal movement with respect thereto; a lever arm extending from said at least one gripper member; a cam follower member mounted on said lever arm, said cam follower member being in contact with said at least one arcuate surface provided on said cam segment member; said swinging gripper apparatus further comprising: a camming wheel having a camming surface provided on the periphery thereof; and said sheet-processing machines having means other than said swinging means; a singular biasing means, for exerting a biasing force on said gripper member in a portion of said singular biasing means being substantially stationarily mounted with respect to a portion of said other means of the sheet-processing machine other than said swinging means.

Another aspect of the invention resides broadly in a swinging gripper apparatus for use in a sheet-processing machine such as a rotary printing press, the sheet-processing machine having a cylinder for receiving, on the periphery thereof, sheets to be printed and a feed table for supplying the sheets to be printed, said swinging gripper apparatus comprising: a rocker arm member, said rocker arm member having a pivotally mounted first end and a second end, said second end of said rocker arm member being selectably positionable between a first position substantially adjacent the cylinder and a second position substantially adjacent the feed table; a cam function segment member, said cam segment having two opposing arcuate camming surfaces provided thereon; means for moving said cam segment member between a first orientation and a second orientation, said cam segment member being closer to said pivotally mounted first end of said rocker arm member in said first orientation than in said second orientation; at least one gripper member pivotally mounted on said second end of said rocker arm member for pivotal movement with respect to said second end of said rocker arm member; a lever arm extending from said at least one gripper member; and a cam follower member mounted on said lever arm, said cam follower member being positioned between said two opposing arcuate surfaces provided on said cam segment member.

Yet another aspect of the invention resides broadly in a swinging gripper apparatus for use in a sheet-processing machine, such as a printing press, the sheet-processing machine having a cylinder for receiving, on the periphery thereof, sheets to be printed and a feed table for supplying the sheets to be printed, said swinging gripper apparatus comprising: a rocker arm member, said rocker arm member having a pivotally mounted first end and a second end which is selectably positionable between a first position substantially adjacent the cylinder and a second position substantially adjacent the feed table; a cam segment member, said cam segment having at least one arcuate camming surface provided thereon; said cam segment member being pivotally mounted about a pivot point and being pivotal about said pivot point between a first orientation and a second orientation, said cam segment member being closer to said pivotally mounted first end of said rocker arm member in said first orientation than in said second orientation; at least one gripper member pivotally mounted on said second end of said rocker arm member for pivotal movement with respect thereto: a lever arm extending from said at least one gripper member; a cam follower member mounted on said lever arm, said cam follower member being in contact with said at least one arcuate surface provided on said cam segment member; a camming wheel having a camming surface provided on the periphery thereof; an additional lever arm connected to said cam segment member and extending radially from said pivot point, said additional lever arm having an additional cam follower member mounted thereon and in contact with said camming surface of said camming wheel; and a further lever arm connected to said cam segment member and extending from said pivot point; a singular biasing means, said singular biasing means being connected to said further lever arm.

Further advantages and details result from the following description of a preferred embodiment of the invention, reference being had to the accompanying drawings, wherein:

DESCRIPTION OF THE PREFERRED EMBODIMENT

Figure 1:
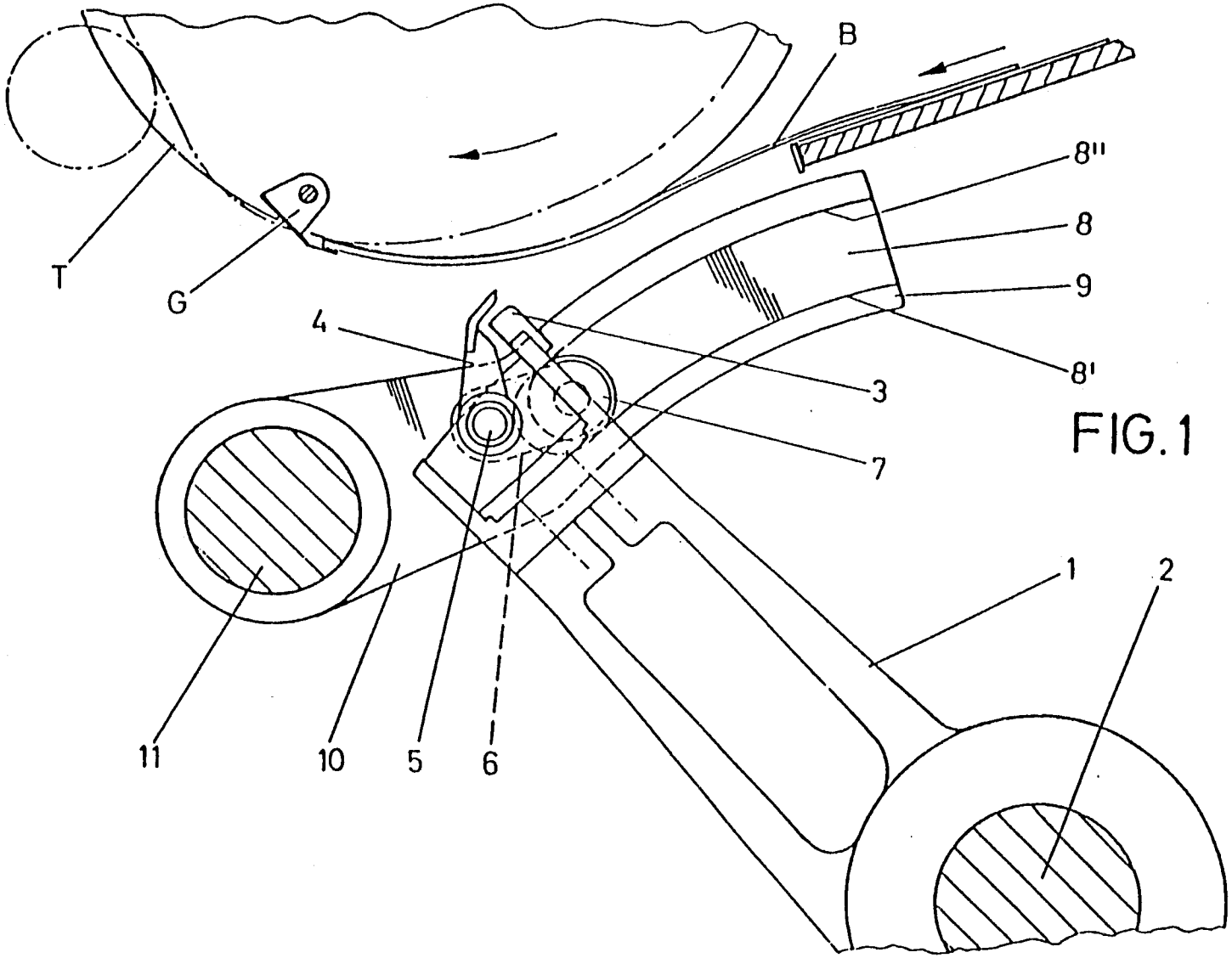
FIGS. 1 and 2 are schematic side views of a swinging gripper arrangement according to the invention in two different operating positions.

Generally, a gripper rocker arm 1 is mounted on a shaft 2 such that the gripper rocker arm 1 may be moved backwards and forwards about the center point of the shaft 2. The gripper rocker arm 1 has mounted thereon a gripper support 3 and grippers 4 disposed movably with respect to the gripper support 3. The gripper support 3 is, preferably, substantially fixedly mounted on the gripper rocker arm 1, while the grippers are substantially fixedly mounted on a gripper shaft 5, the gripper shaft 5 extending transversely across the machine and being rotatably attached to the gripper rocker arm 1, for example, through the provision of U-shaped brackets thereon.

The gripper shaft 5 extends fixedly into an arm 6, the arm 6 bearing at its free end a control roller 7. The control roller 7 runs in a cam slot 8 of a cam segment (or slot having concentric edges) 9. Control edges 8' and 8'' of the cam slot 8 are equidistant from one another, and preferably, extend concentrically with respect to the mid-point of the shaft 2.

The cam segment 9 is seated on an arm 10. The arm 10 is non-rotatingly disposed on a shaft 11 which is supported in machine-frame cheeks 12 and which bears lever arms 13 and 14 on an end 11' that projects on one side beyond one of the machine-frame cheeks 12. At a free end of the lever arm 13 is seated a roller 15. The roller 15 runs on a cam disc 16, which is disposed substantially coaxially with respect to one of the drum shafts of the sheet-processing machine. The other arm 14 is subject to the action of a pair of pressure springs 17. Each pressure spring 17 is provided with an associated nut 18. The loading of the pressure springs 17 is of such a kind that the roller 15 is forced into contact with the cam disc 16 and the cam segment 9 is spring loaded in the direction of the arrow x.

On account of this spring loading in the direction of the arrow x, a spring loading in the closing direction of the grippers 4 is transmitted to the grippers 4 through the intermediary of the control roller 7, when, by corresponding shape of the cam disc 16, the roller 15 releases the shaft 11 for corresponding rotation in the direction of the arrow x. In the reverse direction, the opposite contour of the cam disc 16 guides the grippers 4 via the roller 15 into the open position according to FIG. 1.

Figure 2:
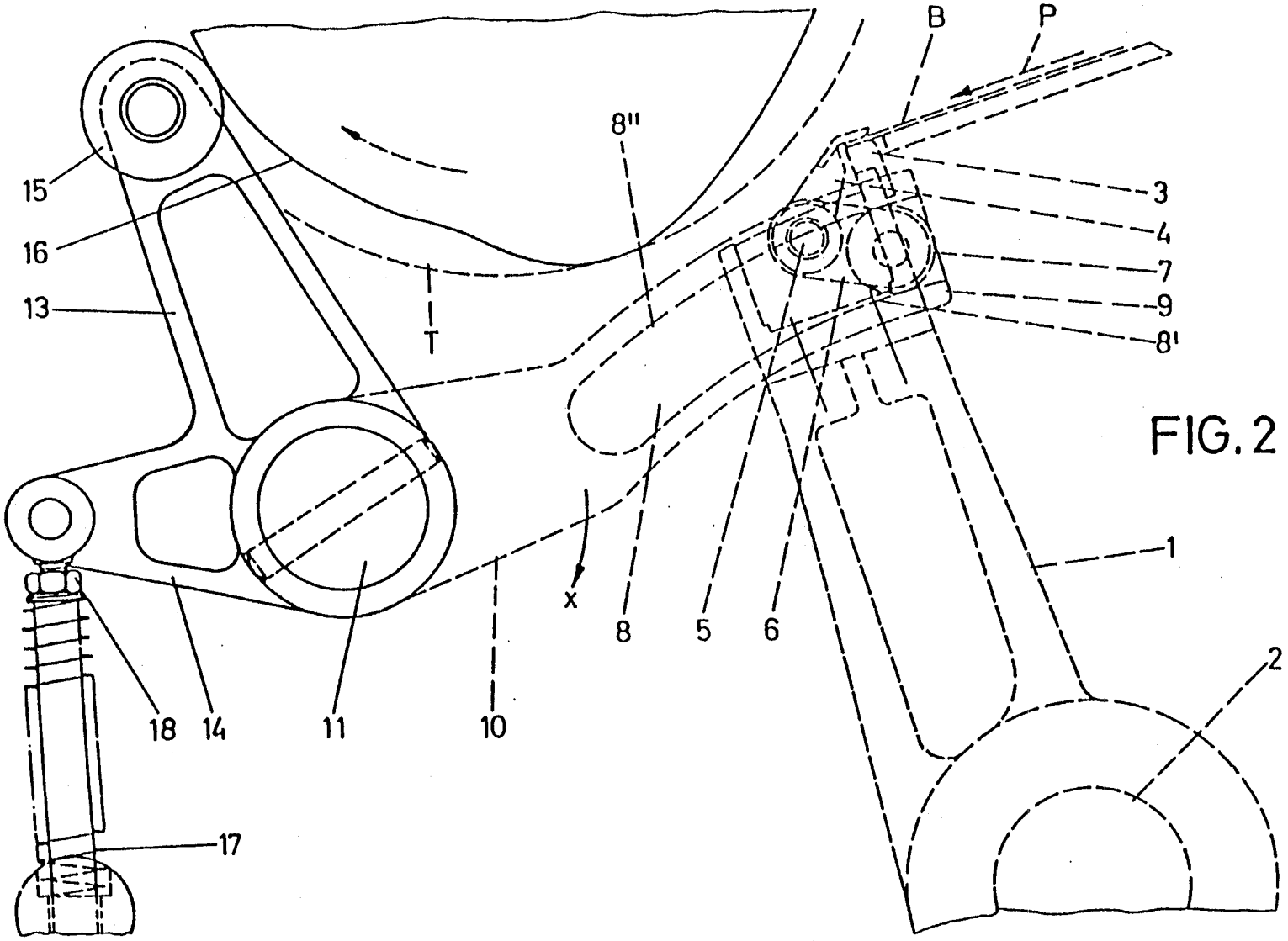

As may be seen from FIG. 2, the gripper accepts, for example, a sheet B which arrives in the direction of the arrow and, being held by the gripper, is passed on to a gripper G of a drum T, as seen in FIG. 1.

In other words, and more specifically, a printing press upon which the invention is to be employed has a drum T, for example, a printing drum or a transfer drum, upon which there is provided a drum mounted gripper G. A camming wheel 16 having a convoluted camming surface is preferably mounted coaxially with drum T for rotation therewith. The printing press also includes a paper feed table, upon which sheets B for printing arrive, travelling in the direction indicated by the arrow P.

A control member is fixedly (i.e., non-rotatably) mounted on a shaft 11, 11', which shaft 11, 11' is itself rotatably supported by the side frames 12 of the printing press. The control member is, therefore, pivotally mounted with respect to the side frames 12 of the printing press.

The control member has three lever arms extending radially from its pivotal mounting point 11. A first of these lever arms 13 is provided with a freely rotating cam follower roller 15. A second of these lever arms 14 is biased (in a clock-wise direction, as shown in FIGS. 1 and 2) by a pair of springs 17, such that the freely rotating cam follower roller 15 is resiliently biased against the surface of the rotating cam member 16. Each spring 17 is provided with an adjusting nut 18 for varying the amount of biasing force exerted by the associated spring 17.

Figure 3:
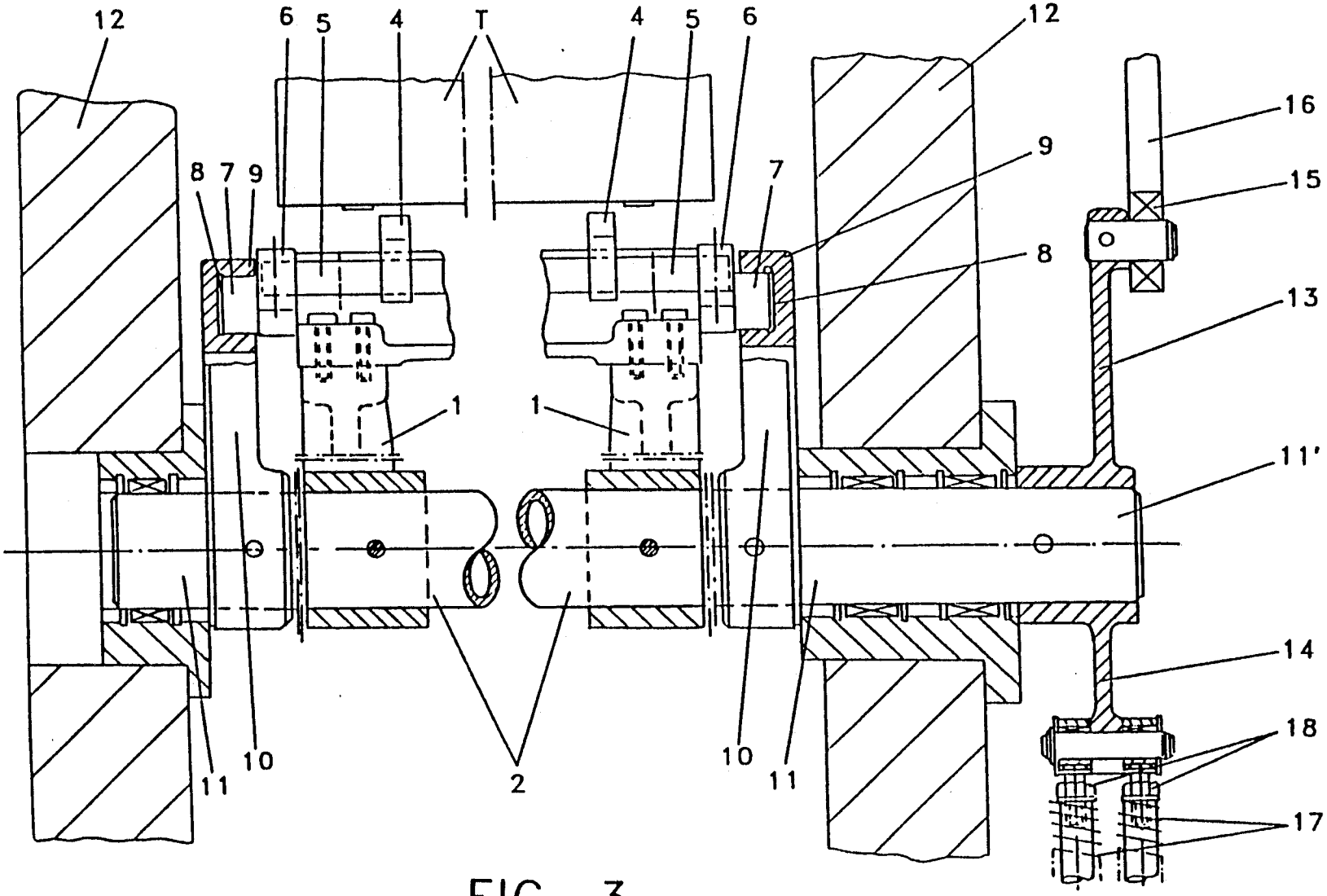
FIG. 3 is an idealized longitudinal cross-section of FIG. 2 in the region of the shaft of the cam segment.

The control member is also provided with a third radially extending arm 10, which, as seen most clearly in FIG. 3, is also preferably fixedly (or non-rotatably)

mounted on shaft 11, however within the side frames 12 of the printing press. From the aforementioned description, it will be appreciated that, upon revolution of the camming wheel 16, the control member, having the three radially extending lever arms 10, 13 and 14, will be caused to execute a reciprocating pivotal motion about the center point of shaft 11. Such movement will, in turn, cause lever arm 10 to execute an up and down rocking motion about the center point of shaft 11, against the biasing force exerted by springs 17.

Lever arm 10 is provided with a cam segment 9 extending therefrom, cam segment 9 having formed thereon a camming recess 8 defined by upper and lower camming surfaces 8'' and 8', respectively, which are preferably concentric arcuate surfaces having the center point of a second shaft 2 as their center points. One of two cam rollers 7 is positioned within each of the camming recesses 8. Each cam roller 7 is rotatably mounted on a lever arm 6, which is, in turn, fixedly connected to a gripper shaft 5 having mounted thereon a plurality of grippers 4.

Figure 4:
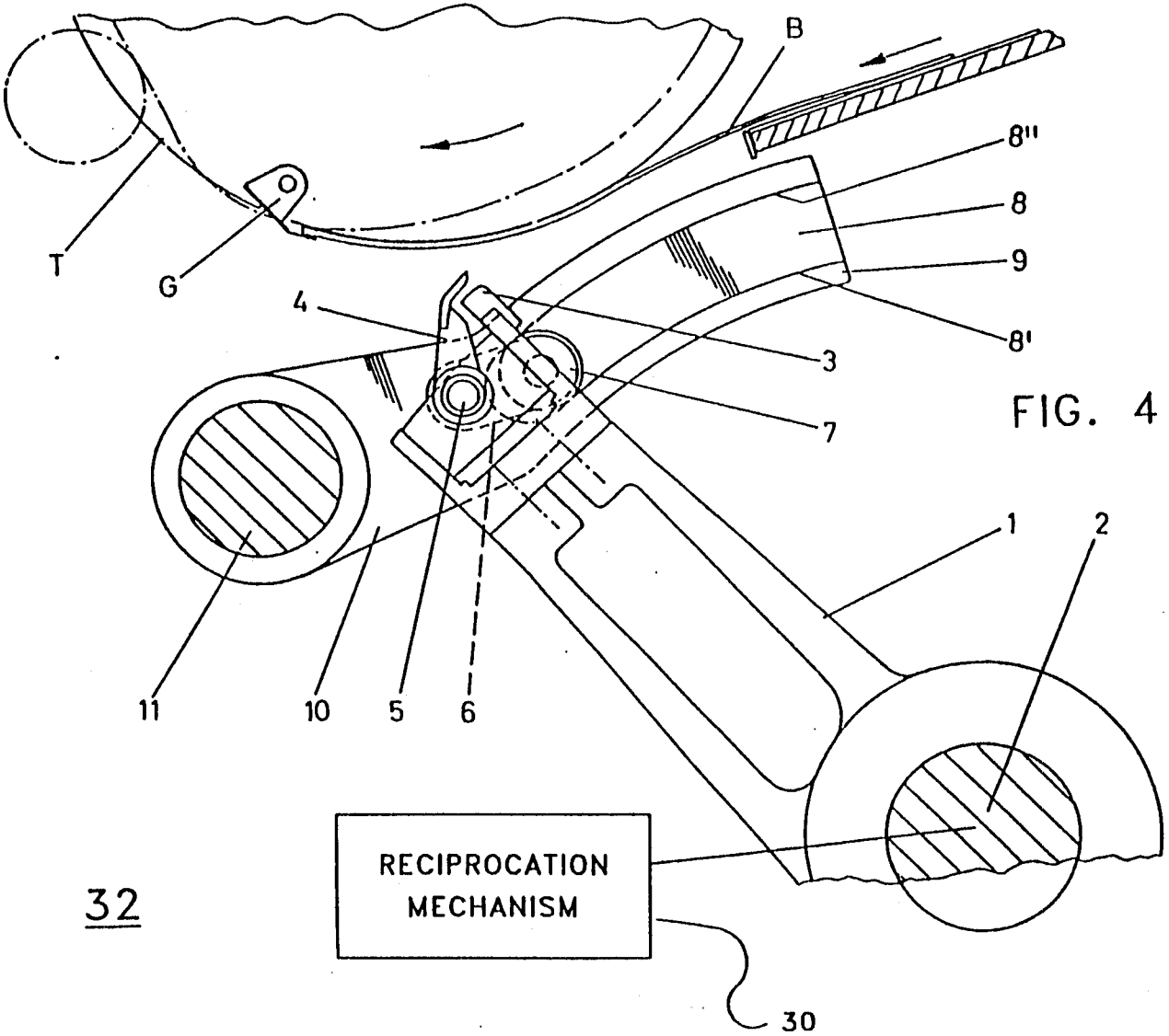
FIG. 4 is similar to FIG. 1, but schematically illustrates a mechanism employed to effect a reciprocating motion of the gripper rocker arm.

A gripper rocker arm 1 is mounted on the second shaft 2 and, as illustrated in FIG. 4, there is provided a reciprocation mechanism 30 for causing gripper rocker arm 1 to execute a reciprocating pivotal movement about the center point of the second shaft 2. Various means, well known to those of ordinary skill in the mechanical arts, may be employed to cause gripper rocker arm 1 to execute such a motion. For example, an oscillating crank mechanism, well known in the art, could be interconnected to gripper rocker arm 1 through an intervening lever arm extending therefrom. Additionally, well known camming mechanisms, such as those shown in U.S. Pat. No. 4,311,093, issued June 19, 1982 to Abendroth, et al. and entitled "Sheet Feeding Assembly Including Provision for Coordinated Action of Pre-Gripper and Front Stop", could also be utilized to cause such a reciprocating pivotal movement of gripper rocker arm 1. Additionally, appropriate gearing and timing mechanisms, also well known in the art, are employed to cause gripper rocker arm 1 to be positioned adjacent the sheet feed table and the gripper G at appropriate times for the transfer of a sheet of paper therebetween.

As shown most clearly in FIG. 3, grippers 4 are fixedly attached to gripper shaft 5 which is, in turn, rotatably mounted on gripper rocker arm 1, and which extends substantially across the entire transverse width thereof. At both of its opposite ends, gripper shaft 5 is fixedly attached to a lever arm 6, each lever arm 6 having a cam roller 7 rotatably mounted thereon.

FIG. 4 is similar to FIG. 1, but schematically illustrates a mechanism employed to effect a reciprocating motion of the gripper rocker arm.

From the above description, it will be appreciated that the angular disposition of gripper rocker arm 1 is determined by reciprocation mechanism 30 as shown in FIG. 4. The entire swinging gripper assembly is denoted by the reference numeral 32 in FIG. 4. On the other hand, the radial distance of cam rollers 7 from the center point of the second shaft 2 is determined by the angular disposition of the third radially extending arm 10 which is, in turn, determined by the positioning of cam follower roller 15 as controlled by the surface of the camming wheel 16.

The opening and closing of the grippers 4 against the grippers support 3 is determined by the particular convoluted camming surface provided on camming wheel 16. When cam follower roller 15 is cammed outwardly, that is, further from the axis of rotation of camming wheel 16, against the biasing force exerted by springs 17, the third radially extending arm 10 and the camming recess 8 provided thereon are rotated in a relatively counter-clock-wise direction. This causes cam rollers 7, which are located within the camming recesses 8 to be moved away from the center point of the center shaft 2, thereby causing a counter-clock-wise rotation of the lever arms 6 about the center point of the gripper shaft 5. Since the lever arms 6 are rigidly connected to the gripper shaft 5, this causes the gripper shaft 5 to be driven in a counter-clockwise rotational motion, thereby opening a gap between the gripper 4 and the gripper support 3.

In contrast, when the cam follower roller 15 is cammed inwardly that is, towards the axis of rotation of the camming wheel 16, under the force exerted by the springs 17, the third radially extending arm 10 and the camming recess 8 provided thereon are rotated in a clock-wise direction, thereby moving the cam rollers 7 towards the center point of the second shaft 2. The lever arms 6 thereby cause a clock-wise rotation of the gripper shaft 5 and a consequential pivotal closing of the grippers 4 against the gripper support 3.

The particular convoluted shape chosen for the surface of the camming wheel 16, which controls the timing of the opening and closing of the grippers 4 can, therefore, be chosen by the designer, in accordance with the requirements of a particular application.

Figure 5:
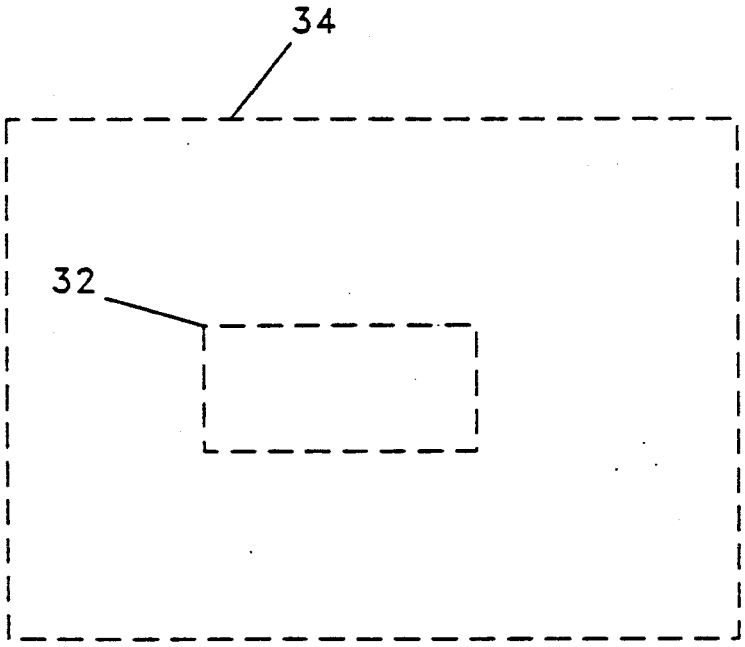
FIG. 5 shows an embodiment of the invention in a printing press.

FIG. 5 shows a typical printing press or a sheet processing machine which may be a printing press 34 such as a sheet-fed offset printing press with the swinging gripper assembly 32 therein.

One aspect of the invention resides broadly in a gripper arrangement on sheet-processing machines, in particular sheet-fed offset printing presses, with gripper supports, said gripper supports being disposed at the end of a rocker, and with grippers assigned to said gripper supports in a spring-loaded manner, the movement of said grippers being controlled by means of a cam segment, said cam segment being swivelable against spring loading by means of a feeler roller, said feeler running over a cam disc, characterized in that the spring loading of the grippers 4 results from the spring loading 17 of one or more cam segments 9.

Another aspect of the invention resides broadly in a gripper arrangement characterized in that the spring loading of the grippers 4 results from the spring loading of two cam segments 9.

Another further aspect of the invention resides broadly in a gripper arrangement characterized in that the grippers 4 are connected to an arm 6 bearing a control roller 7, said control roller 7 running in a positive non-slip manner in a rocker cam 8 of the cam segment 9, the control edges 8' and 8'' of said cam segment 9 being equidistant from one another and extending concentrically with respect to the shaft 2 of the gripper rocker 1.

Still a further aspect of the invention resides broadly in a gripper arrangement characterized in that the cam segment 9 is formed by one arm 10 of three lever arms, said lever arms being disposed on a shaft 11, the second lever arm 14 of which three lever arms serves to engage the loading spring 17 while the third lever arm 13 bears the feeler roller 15.

An example of a sheet feeding assembly is found in U.S. Pat. No. 4,311,093 entitled "Sheet Feeding Assembly Including Provision For Coordination Action of Pre-Gripper and Front Stop" which may have a gripper activation arrangement which may have parts which are analogous to those usable in the printing press of an embodiment of the present invention.

Another example of a sheet feeding assembly is found in U.S. Pat. No. 4,475,459 entitled "Impression Cylinder For Sheet-Fed Rotogravure Presses" which may have parts which are analogous to those usable in the printing press of an embodiment of the present invention.

Yet another example of a gripper movement changeover device is found in U.S. Pat. No. 4,120,244 entitled "Gripper Movement Changeover Device On A Sheet-Turning Drum For Perfector Printing Machines" which may have parts which are analogous to those usable in the printing press of an embodiment of the present invention.

All, or substantially all, of the components and methods of the various embodiments of at least one embodiment of the invention may be used with all of the embodiments thereof, if any, described herein.

All of the patents, patent applications and publications recited herein, if any, are hereby incorporated by reference as if set forth in their entirety herein.

The invention as described hereinabove in the context of a preferred embodiment is not to be taken as limited to all of the provided details thereof, since modifications and variations thereof may by made without departing from the spirit and scope of the invention.

What is claimed is:

1. A swinging gripper apparatus for use in a sheet-processing machine, such as a printing press, wherein the sheet-processing machine has a cylinder for receiving, on the periphery thereof, sheets to be printed, a feed table for supplying the sheets to be printed and at least one stationary portion of the sheet-processing machine, said swinging gripper apparatus comprising:

swinging means, said swinging means comprising:

a rocker arm member, said rocker arm member having a pivotally mounted first end and a second end, said second end of said rocker arm member being selectably positionable about said pivotally mounted first end between a first position substantially adjacent the cylinder and a second position substantially adjacent the feed table;

means for moving said rocker arm member between said first position and said second position;

a cam function segment member, said cam segment having at least one arcuate camming surface provided thereon;

a pivot point being stationarily mounted on one of the at least one stationary portion of the sheet-processing machine;

said cam segment member being pivotally mounted about said pivot point and being pivotal about said pivot point between a first orientation and a second orientation, said cam segment member being closer to said pivotally mounted first end of said rocker arm member in said first orientation than in said second orientation;

at least one gripper member pivotally mounted on said second end of said rocker arm member for pivotal movement with respect thereto;

a lever arm extending from said at least one gripper member;

a cam follower member mounted on said lever arm, said cam follower member being in contact with said at least one arcuate surface provided on said cam segment member; said swinging gripper apparatus further comprising:

a camming wheel having a camming surface provided on the periphery thereof;

a singular biasing means, for exerting a biasing force on said gripper member; and a portion of said singular biasing means being substantially stationarily mounted on one of the at least one stationary portion of the sheet-processing machine.

2. A swinging gripper apparatus according to claim 1, wherein said single biasing element comprising at least two springs.

3. A swinging gripper apparatus for use in a sheet-processing machine, such as a printing press, the sheet-processing machine having a cylinder for receiving, on the periphery thereof, sheets to be printed and a feed table for supplying the sheets to be printed, said swinging gripper apparatus comprising:

a rocker arm member, said rocker arm member having a pivotally mounted first end and a second end, said second end of said rocker arm member being selectably positionable about said pivotally mounted first end between a first position substantially adjacent the cylinder and a second position substantially adjacent the feed table;

means for moving said rocker arm member between said first position and said second position;

a cam function segment member, said cam function segment member having at least one arcuate camming surface provided thereon;

a pivot point being stationarily mounted on the sheet-processing machine;

said cam segment member being pivotally mounted about said pivot point and being pivotal about said pivot point between a first orientation and a second orientation, said cam segment member being closer to said pivotally mounted first end of said rocker arm member in said first orientation than in said second orientation;

at least one gripper member pivotally mounted on said second end of said rocker arm member for pivotal movement with respect thereto;

a lever arm extending from said at least one gripper member;

a cam follower member mounted on said lever arm, said cam follower member being in contact with said at least one arcuate surface provided on said cam segment member;

a camming wheel having a camming surface provided on the periphery thereof;

an additional lever arm connected to said cam segment member and extending radially from said pivot point, said additional lever arm having an additional cam follower member mounted thereon and in contact with said camming surface of said camming wheel; and a further lever arm connected to said cam segment member and extending from said pivot point;

a singular biasing means, said singular biasing means being connected to said further lever arm.

4. A swinging gripper apparatus according to claim 3, wherein said single biasing element comprises at least two springs.

5. A swinging gripper apparatus for use in a sheet-processing machine, such as a rotary printing press, the sheet-processing machine having a cylinder for receiving, on the periphery thereof, sheets to be printed and a feed table for supplying the sheets to be printed, said swinging gripper apparatus comprising:

a rocker arm member, said rocker arm member having a pivotally mounted first end and a second end, said second end of said rocker arm member being selectably positionable about said pivotally mounted first end between a first position substantially adjacent the cylinder and a second position substantially adjacent the feed table;

means for moving said rocker arm member between said first position and said second position;

a cam function segment member, said cam function segment member having two opposing, internal arcuate camming surfaces provided therein;

means for moving said cam segment member between a first orientation and a second orientation, said cam segment member being closer to said pivotally mounted first end of said rocker arm member in said first orientation than in said second orientation;

at least one gripper member pivotally mounted on said second end of said rocker arm member for pivotal movement with respect to said second end of said rocker arm member;

a lever arm extending from said at least one gripper member; and a sole cam follower member mounted on said lever arm, said cam follower member being positioned between said two opposing arcuate surfaces provided on said cam segment member.

6. A swinging gripper apparatus according to claim 5, wherein the sheet-processing machine has at least one stationary portion thereof, said swinging gripper apparatus further comprising:

a pivot point being stationarily mounted on one of the at least one stationary portion of the sheet-processing machine; and said am segment member being pivotally mounted about said pivot point.

7. A swinging gripper apparatus according to claim 6, wherein said means for moving said cam segment between said first orientation and said second orientation comprises biasing means for biasing said cam segment member towards one of said first and second orientations, a rotating camming surface, and an additional lever arm connected to said cam segment member, said additional lever arm having an additional cam follower member mounted thereon and in contact with said rotating camming surface.

8. A swinging gripper apparatus according to claim 7, wherein said additional lever arm extends from said pivot point, and wherein said biasing means comprises a further lever arm extending from said pivot point and a spring member exerting a biasing force on said further lever arm about said pivot point.

9. A swinging gripper apparatus according to claim 8, wherein said cam segment member, said additional lever arm and said further lever arm are formed as a substantially single integral member, said substantially single integral member being mounted for pivotal rotation about said pivot point.

10. A swinging gripper apparatus according to claim 9, wherein, in at least one of said first and second orientations of said cam segment member, said two opposing, internal camming surfaces form substantially circular arcs having a common center of curvature located at the pivot point of said pivotally mounted first end of said rocker arm member.

11. A swinging gripper apparatus according to claim 10, wherein said spring member is a compression spring.

12. A swinging gripper apparatus according to claim 11, wherein said cam follower member is a substantially circular member.

13. A swinging gripper apparatus according to claim 12, wherein said substantially circular cam follower member is rotatably mounted on said lever arm.

14. A swinging gripper apparatus according to claim 13, wherein said additional cam follower member comprises a substantially circular member rotatably mounted on said lever arm.

15. A swinging gripper apparatus according to claim 6, wherein, in at least one of said first and second orientations of said cam segment member, said two opposing, internal camming surfaces form substantially circular arcs having a common center of curvature located at the pivot point of said pivotally mounted first end of said rocker arm member.

16. A swinging gripper apparatus according to claim 8, wherein, in at least one of said first and second orientations of said cam segment member, said two opposing, internal camming surfaces form substantially circular arcs having a common center of curvature located at the pivot point of said pivotally mounted first end of said rocker arm member.

17. A swinging gripper apparatus according to claim 8, wherein said spring member is a compression spring.

18. A swinging gripper apparatus according to claim 5, wherein said means for moving said cam segment between said first orientation and said second orientation comprises biasing means for biasing said cam segment member towards one of said first and second orientations, a rotating camming surface, and an additional lever arm connected to said cam segment member, said additional lever arm having an additional cam follower member mounted thereon and in contact with said rotation camming surface.

19. A swinging gripper apparatus according to claim 18, wherein, in at least one of said first and second orientations of said cam segment member, said two opposing, internal camming surfaces form substantially circular arcs having a common center of curvature located at the pivot point of said pivotally mounted first end of said rocker arm member.

20. A swinging gripper apparatus according to claim 5, wherein said two opposing, internal camming surfaces are arcuate and substantially parallel to one another.

21. A swinging gripper apparatus according to claim 5, wherein, in at least one of said first and second orientations of said cam segment member, said two opposing, internal camming surfaces form substantially circular arcs having a common center of curvature located at the pivot point of said pivotally mounted first end of said rocker arm member.

22. A swinging gripper apparatus according to claim 14, wherein said single biasing element comprises at least two springs.

* * * * *

UNITED STATES PATENT AND TRADEMARK OFFICE

CERTIFICATE OF CORRECTION

PATENT NO. : 5,076,165

DATED : December 31, 1991

INVENTOR(S) : Gerhard POLLICH

It is certified that error appears in the above-identified patent and that said Letters Patent is hereby corrected as shown below:

In column 8, line 5, Claim 1, after 'means' and before the comma, insert --consisting of a single biasing element--.

In column 8, line 60, Claim 3, after 'means' and before the comma, insert --consisting of a single biasing element--.

In column 9, immediately after line 24, Claim 5, insert the phrase --a singular biasing means consisting of a single biasing element, for exerting a biasing force on said gripper member--.

In column 9, line 38, Claim 6, after 'said', delete "am" and insert --cam--.

Signed and Sealed this

Nineteenth Day of October, 1993

*Attest:*

Bruce Lehman

BRUCE LEHMAN

*Attesting Officer*

*Commissioner of Patents and Trademarks*